US005878754A

United States Patent [19]

Peterson et al.

[11] Patent Number: 5,878,754

[45] Date of Patent: Mar. 9, 1999

[54] SMOKING ARTICLE WRAPPER FOR CONTROLLING IGNITION PROCLIVITY OF A SMOKING ARTICLE

[75] Inventors: Richard M. Peterson; John H. Goodrow, both of Marietta, Ga.; Joseph S. Kucherovsky, Philadelphia, Pa.

[73] Assignee: Schweitzer-Mauduit International, Inc., Alpharetta, Ga.

[21] Appl. No.: 815,878

[22] Filed: Mar. 10, 1997

[51] Int. Cl.[6] ..... A24D 1/02

[52] U.S. Cl. ..... 131/365; 131/349; 131/358; 424/52

[58] Field of Search ..... 131/365, 358, 131/351, 349, 336; 424/51, 54, 49

[56] References Cited

U.S. PATENT DOCUMENTS

| | | |
|---|---|---|
| 218,389 | 8/1879 | Lucas . |
| 225,858 | 3/1880 | O'Connor . |

(List continued on next page.)

FOREIGN PATENT DOCUMENTS

| | | |
|---|---|---|
| 175148 | 6/1953 | Australia . |
| 265901 | 8/1960 | Australia . |
| 537531 | 5/1955 | Belgium . |
| 659839 | 3/1965 | Belgium . |
| 175005 | of 1917 | Canada . |
| 496123 | 9/1953 | Canada . |
| 694631 | 9/1964 | Canada . |
| 835684 | 3/1970 | Canada . |
| 281967A | 9/1988 | European Pat. Off. . |
| 483998A | 5/1992 | European Pat. Off. . |
| 486213A1 | 5/1992 | European Pat. Off. . |
| 0559300A2 | 9/1993 | European Pat. Off. . |
| 1040981 | 5/1955 | France . |
| 1517262 | 3/1968 | France . |
| 1560360 | 3/1968 | France . |
| 2556184A | 6/1985 | France . |
| 549936 | 5/1932 | Germany . |
| 608407 | 1/1935 | Germany . |
| 613294 | 5/1935 | Germany . |
| 146513 | 7/1936 | Germany . |
| 1959684 | 6/1971 | Germany . |
| 2206185 | 8/1972 | Germany . |
| 2120586 | 11/1972 | Germany . |
| 2162168 | 7/1973 | Germany . |
| 2308658 | 8/1974 | Germany . |
| 2308667 | 9/1974 | Germany . |
| 2444929 | 4/1975 | Germany . |
| 2537334 | 3/1976 | Germany . |
| 2906417 | 8/1980 | Germany . |
| 3741008A | 6/1988 | Germany . |
| 4202750A1 | 8/1993 | Germany . |
| 317118 | 4/1933 | Italy . |
| 54052686 | 4/1979 | Japan . |
| 48468 | 6/1909 | Switzerland . |
| 142429 | 11/1930 | Switzerland . |
| 240987 | 6/1946 | Switzerland . |

(List continued on next page.)

OTHER PUBLICATIONS

"New Process fire–proofs cigarettes", Tabacco, pp. 12, 14, Jan. 21, 1997.

*Primary Examiner*—John G. Weiss
*Assistant Examiner*—Charles W. Anderson
*Attorney, Agent, or Firm*—Dority & Manning, P.A.

[57] ABSTRACT

A smoking article wrapper having improved ignition proclivity characteristics includes discrete areas of an outer circumferential surface of the wrapper treated with a non-aqueous solution of a solvent soluble cellulosic polymer dissolved in a non-aqueous solvent. The solution also includes a particulate inorganic non-reactive filler suspended in solution by weight percentage of solution. The solution is applied in discrete areas as bands or patterns causing reduced permeability of the treated areas within a permeability range adequate to reduce ignition proclivity. A method is also provided for producing a smoking article wrapper having improved ignition proclivity characteristics as described.

34 Claims, 3 Drawing Sheets

U.S. PATENT DOCUMENTS

| | | | |
|---|---|---|---|
| 625,293 | 5/1899 | Doutney . | |
| 671,548 | 4/1901 | Gordon . | |
| 1,555,320 | 9/1925 | Weil . | |
| 1,581,451 | 4/1926 | Knapp . | |
| 1,605,059 | 11/1926 | Oakes et al. . | |
| 1,666,062 | 4/1928 | Alexander . | |
| 1,726,737 | 9/1929 | Harris . | |
| 1,744,615 | 1/1930 | Crosthwait . | |
| 1,770,616 | 7/1930 | Kean . | |
| 1,798,537 | 3/1931 | Honigbaum . | |
| 1,862,679 | 6/1932 | Holsman . | |
| 1,863,000 | 6/1932 | Barnes . | |
| 1,879,128 | 9/1932 | Desper . | |
| 1,905,416 | 4/1933 | Low . | |
| 1,996,002 | 3/1935 | Seaman . | |
| 1,999,222 | 4/1935 | Weinberger . | |
| 2,013,508 | 9/1935 | Seaman . | |
| 2,028,552 | 1/1936 | Low et al. . | |
| 2,049,320 | 7/1936 | Ruben et al. . | |
| 2,098,619 | 11/1937 | Finnell . | |
| 2,147,889 | 2/1939 | Gardiner et al. . | |
| 2,185,293 | 1/1940 | Copeman . | |
| 2,246,929 | 6/1941 | Seney . | |
| 2,307,088 | 1/1943 | Whiteley . | |
| 2,327,991 | 8/1943 | Betts . | |
| 2,329,927 | 9/1943 | Morton . | |
| 2,547,119 | 4/1951 | Henderson . | |
| 2,666,437 | 1/1954 | Lattof . | |
| 2,682,270 | 6/1954 | Schur . | |
| 2,718,889 | 9/1955 | Claussen . | |
| 2,746,890 | 5/1956 | Legler . | |
| 2,754,828 | 7/1956 | Swain . | |
| 2,775,970 | 1/1957 | Schoenbaum . | |
| 2,890,704 | 6/1959 | Lamm . | |
| 2,976,190 | 3/1961 | Meyer . | |
| 2,985,175 | 5/1961 | Rich . | |
| 2,992,647 | 7/1961 | Figge . | |
| 2,998,012 | 8/1961 | Lamm . | |
| 3,030,963 | 4/1962 | Cohn . | |
| 3,081,776 | 3/1963 | Park . | |
| 3,091,243 | 5/1963 | Guida . | |
| 3,102,543 | 9/1963 | O'Siel et al. . | |
| 3,165,105 | 1/1965 | Campbell . | |
| 3,220,418 | 11/1965 | Cohn . | |
| 3,228,402 | 1/1966 | Lebert . | |
| 3,276,453 | 10/1966 | Corley . | |
| 3,285,253 | 11/1966 | Lebert . | |
| 3,288,145 | 11/1966 | Rosenthal . | |
| 3,349,776 | 10/1967 | Bell et al. . | |
| 3,370,593 | 2/1968 | Owaki . | |
| 3,528,432 | 9/1970 | Stossel . | |
| 3,632,384 | 1/1972 | Saint-Pastou . | |
| 3,702,117 | 11/1972 | Borthwick . | |
| 3,736,940 | 6/1973 | Saint-Pastou . | |
| 3,903,899 | 9/1975 | Musillo | 131/15 R |
| 3,977,416 | 8/1976 | Akiba . | |
| 3,985,143 | 10/1976 | Lappin, Jr. . | |
| 4,044,778 | 8/1977 | Cohn . | |
| 4,061,147 | 12/1977 | Falchi . | |
| 4,077,414 | 3/1978 | Baker et al. . | |
| 4,091,821 | 5/1978 | Scorzo . | |
| 4,121,597 | 10/1978 | Shin . | |
| 4,146,040 | 3/1979 | Cohn . | |
| 4,226,249 | 10/1980 | Newman . | |
| 4,230,131 | 10/1980 | Simon . | |
| 4,231,377 | 11/1980 | Cline et al. . | |
| 4,236,532 | 12/1980 | Schweizer et al. . | |
| 4,243,053 | 1/1981 | Cartwright et al. . | |
| 4,303,084 | 12/1981 | Simon . | |
| 4,407,308 | 10/1983 | Baker et al. . | |
| 4,420,002 | 12/1983 | Cline . | |
| 4,436,101 | 3/1984 | Seatts . | |
| 4,450,847 | 5/1984 | Owens . | |
| 4,452,259 | 6/1984 | Norman et al. . | |
| 4,453,553 | 6/1984 | Cohn . | |
| 4,461,311 | 7/1984 | Mathews et al. . | |
| 4,480,650 | 11/1984 | Weinert . | |
| 4,489,738 | 12/1984 | Simon . | |
| 4,607,647 | 8/1986 | Dashley et al. . | |
| 4,615,345 | 10/1986 | Durocher . | |
| 4,622,983 | 11/1986 | Mathews et al. . | |
| 4,624,268 | 11/1986 | Baker et al. . | |
| 4,643,205 | 2/1987 | Redding et al. . | |
| 4,739,775 | 4/1988 | Hampl, Jr. . | |
| 4,805,644 | 2/1989 | Hampl, Jr. et al. . | |
| 4,889,145 | 12/1989 | Adams et al. . | |
| 4,909,854 | 3/1990 | Light et al. . | |
| 4,945,932 | 8/1990 | Mentzel et al. . | |
| 5,057,158 | 10/1991 | Rohr et al. . | |
| 5,060,675 | 10/1991 | Milford et al. . | |
| 5,103,844 | 4/1992 | Hayden et al. . | |
| 5,120,368 | 6/1992 | Houminer et al. . | |
| 5,129,954 | 7/1992 | Chan et al. . | |
| 5,161,550 | 11/1992 | Owens, Jr. . | |
| 5,259,404 | 11/1993 | Case et al. | 131/365 |
| 5,271,419 | 12/1993 | Arzonico et al. . | |

FOREIGN PATENT DOCUMENTS

| | | |
|---|---|---|
| 622411 | 4/1981 | Switzerland . |
| 14494 | 11/1884 | United Kingdom . |
| 264045 | 1/1927 | United Kingdom . |
| 528190 | 10/1940 | United Kingdom . |
| 646020 | 11/1950 | United Kingdom . |
| 672298 | 5/1952 | United Kingdom . |
| 760772 | 11/1956 | United Kingdom . |
| 835923 | 5/1960 | United Kingdom . |
| 933161 | 8/1963 | United Kingdom . |
| 1056941 | 2/1967 | United Kingdom . |
| 1214319 | 12/1970 | United Kingdom . |
| 1436073 | 5/1976 | United Kingdom . |
| 2020535 | 11/1979 | United Kingdom . |
| 2025753 | 1/1980 | United Kingdom . |
| 2145919 | 4/1985 | United Kingdom . |
| 8601377 | 3/1986 | WIPO . |
| 8606591 | 11/1986 | WIPO . |

Fig. 3A
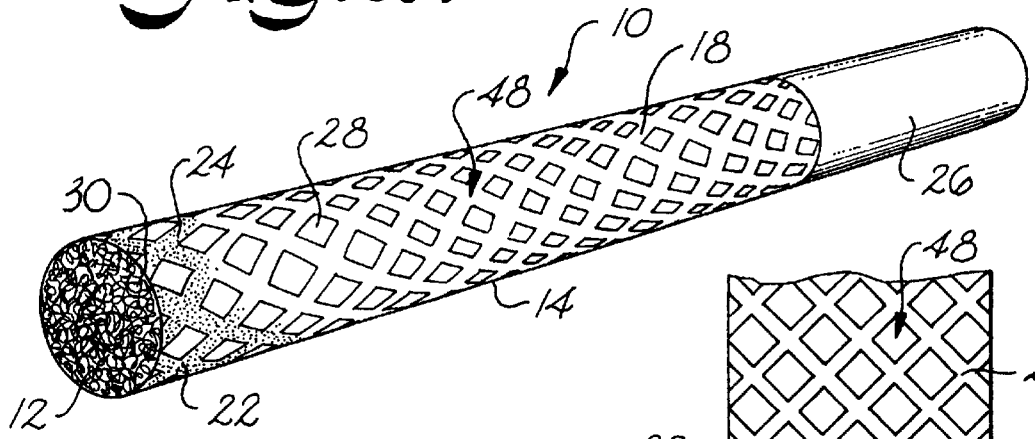
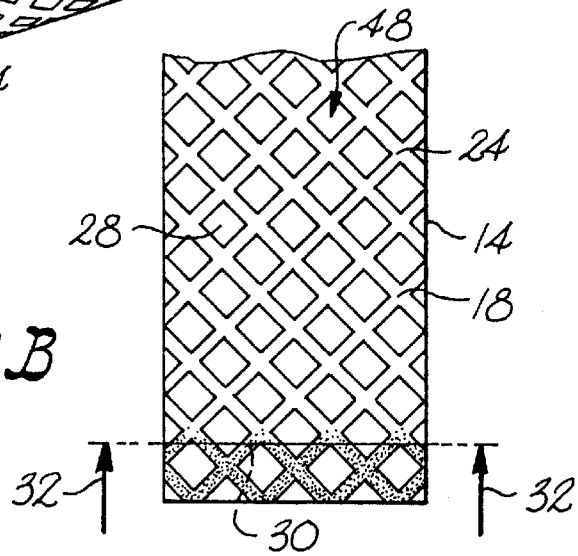
Fig. 3B
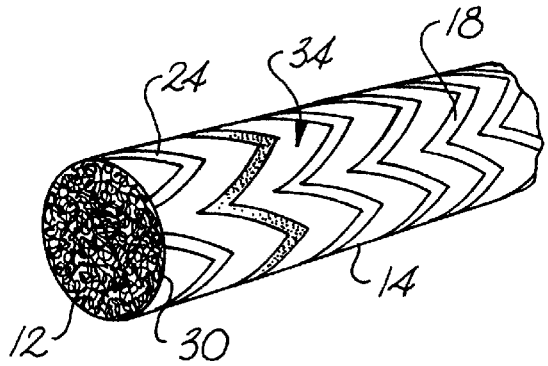
Fig. 4A
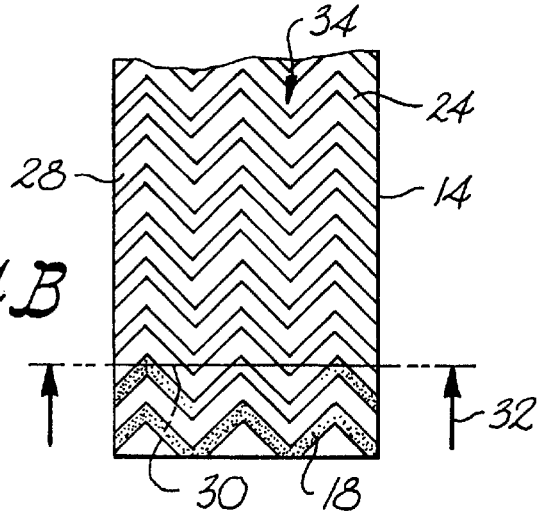
Fig. 4B

SMOKING ARTICLE WRAPPER FOR CONTROLLING IGNITION PROCLIVITY OF A SMOKING ARTICLE

BACKGROUND OF THE INVENTION

The present invention relates to a smoking article wrapper composition for significantly reducing ignition proclivity of the smoking article, and a method of making the smoking article wrapper composition. The invention particularly relates to an improved wrapper paper for cigarettes wherein the cigarettes tend to self extinguish if left or dropped on a flammable substrate before igniting the substrate.

There is an ongoing concern in the industry to produce cigarettes having wrappers which reduce the ignition proclivity of the smoking article, in other words the tendency of the smoking article to cause ignition of surfaces which come into contact with the lit smoking article. Reports have been made of fires attributed to burning cigarettes coming into contact with combustible materials. A justifiable interest exists in the industry to reduce the tendency of cigarettes, or other smoking articles, to ignite surfaces and materials used in furniture, bedding, and the like upon contact.

Thus, a desirable feature of smoking articles, particularly cigarettes, is that they self-extinguish upon being dropped or left in a free burning state on combustible materials.

It has long been recognized in the industry that the cigarette wrapper has a significant influence on the smolder characteristics of the cigarette. In this regard, various attempts have been made in the art to alter or modify cigarette wrappers in order to achieve the desired tendency of the cigarette to self extinguish, or to reduce the ignition proclivity characteristics of cigarettes.

For example, it is known in the art to treat bands or other areas of the cigarette paper to reduce the air permeability within the treated areas. It is known from U.S. Pat. No. 4,452,259 to define at least one circumferential band on the wrapper of a smoking article which will hopefully cause the smoking article to extinguish under free burn conditions. The band is formed by applying a liquid substance or compound to the cigarette paper which has a liquid form in a temperature range of about 100° C. to 200° C. This reference teaches that, as the burning cone of the cigarette comes into contact with the band, a film is formed on the cigarette paper as the substance changes to liquid form which substantially restricts the flow of air to the burning coal.

U.S. Pat. No. 4,945,932 teaches another method of providing areas of decreased air permeability which cause the cigarette to self extinguish as the cigarette smolders or burns into the areas of reduced permeability. The '932 patent teaches to form patterned or annular zones in the cigarette paper by multiple batonneing of the paper, for example, by use of an embossing calendar.

U.S. Pat. No. 4,077,414 discloses the use of printed bands of material on cigarette paper to control the burn rate of the cigarette. Although this reference does not particularly address ignition proclivity, it teaches to provide relatively narrow low porosity bands along the cigarette. The bands are formed by applying a gel-forming substance to the paper by painting, printing, or other coating techniques. The reference teaches that preferred gel-forming substances are those which form gels in water, such as gelatin, alginates, methyl cellulose, methylethyl cellulose and gums. Water insoluble substances such as lacquers and varnishes may also be used in an organic solvent.

U.S. Pat. No. 4,889,145 is another reference that teaches providing areas of reduced porosity along the cigarette by applying a discontinuous coating of a porosity reducing composition. This reference is not particularly concerned with ignition proclivity of the smoking article, but with controlling the puff count and tar delivery of the smoking article. This reference also teaches to include a burn promoter in the wrapper to balance the effect of the discontinuous coating areas.

Various other applications and processes for reducing ignition proclivity of a cigarette are known as, for example, by U.S. Pat. No. 4,453,553; U.S. Pat. No. 4,480,650; U.S. Pat. No. 4,739,775; U.S. Pat. No. 4,489,738; U.S. Pat. No. 4,715,345; U.S. Pat. No. 2,666,437; U.S. Pat. No. 4,622,983; and European Patent Application 0 559 300 82.

Although, as set forth in the above identified references, it has been known in the art to attempt to reduce ignition proclivity tendencies of cigarettes by defining discrete areas of reduced porosity or air permeability along the cigarette, the prior art has not provided an economically feasible method of producing such cigarettes on a commercial scale. Cigarettes are produced in relatively high speed commercial processes and any process or system for reducing the permeability of the cigarette paper to control ignition proclivity must be compatible with the high speed cigarette manufacturing process. Thus far, the systems and processes known in the art have been unacceptable in this regard. For example, the known processes are not compatible with conventional high speed printing techniques for applying the porosity reducing solutions to the cigarette wrappers in a high speed commercial operation. Attempts have been made to apply aqueous solutions to the cigarette wrappers, but such attempts have been generally unsuccessful. The aqueous solutions significantly reduce the strength of the paper and also cause the paper to crinkle or pucker in the coated areas. Cigarettes made with these wrappers have a non-uniform and unappealing outer surface.

Thus, what is needed, is a method (and resulting article) for manufacturing a smoking article wrapper wherein a film forming non-aqueous solution is applied to the cigarette paper in discrete areas or bands by way of conventional high speed printing techniques such that a reduced air permeability is achieved in the treated areas which promotes self extinguishing of the cigarette and does not adversely affect taste or quality of the cigarette.

OBJECTS AND SUMMARY OF THE INVENTION

It is a principle object of the present invention to provide a smoking article, particularly a cigarette, having improved ignition proclivity characteristics.

Another object of the present invention is to provide a smoking article wrapper for use with smoking articles, particularly cigarettes, which promotes self-extinguishing of the smoking article if the article is dropped or left unattended on a flammable substrate.

And yet another object of the present invention is to provide a method for producing a smoking article wrapper having improved ignition proclivity characteristics on a commercially feasible production scale.

And still a further object of the present invention is to provide a smoking article having improved ignition proclivity characteristics without adversely affecting the taste of the smoking article.

Another object of the present invention is to provide a smoking article wrapper which improves the ignition proclivity of the smoking article without affecting the outward or aesthetic appearance of the smoking article.

Still a further object of the present invention is to provide a smoking article wherein the mechanism for improving ignition proclivity does not adversely affect smoke delivery or taste of the smoking article.

An additional object of the present invention is to provide a wrapper for smoking articles which significantly reduces ignition proclivity of the smoking article without adversely affecting smoking characteristics.

Additional objects and advantages of the invention will be set forth in part in the following description, or may be obvious from the description, or may be learned through practice of the invention. The objects and advantages of the invention may be realized and attained by means of the instrumentalities and combinations particularly pointed out in the appended claims.

To achieve the objects and in accordance with the purposes of the invention, as embodied and broadly described herein, an embodiment of the invention includes a smoking article having improved ignition proclivity characteristics. The smoking article includes a tobacco column within a wrapper. The wrapper includes a paper web defining an outer circumferential surface. Discrete areas of the outer circumferential surface are treated with a non-aqueous solution of a solvent soluble cellulosic polymer dissolved in a non-aqueous solvent. The solution also includes a particulate inorganic non-reactive filler suspended in the solution. The treated discrete areas have a relatively smooth and flat texture and comprise a permeability within a predetermined range which is known to reduce ignition proclivity if the cigarette is dropped or otherwise left unattended on a flammable substrate. The treated areas provide improved ignition proclivity characteristics by reducing oxygen to a smoldering coal of the cigarette as the coal advances into the treated areas. A target permeability of the treated areas which applicants have found to be successful is less than 6 ml/min/cm$^2$, and generally within a range of essentially 2 to 6 ml/min/cm$^2$.

In an embodiment of the invention, the areas treated with the non-aqueous solution include a plurality of discrete bands which are disposed circumferentially around the smoking article and spaced apart longitudinally along the article. The bands may have a width of greater than 4 mm in order to ensure that the smoldering coal does not burn through the treated area before the smoking article is extinguished. The bands may be spaced from each other at a distance of essentially between 5 and 10 mm.

In additional embodiments of the invention, the treated areas are defined on the wrapper in a pattern such that a circumferential burn line advancing in a burning direction of the smoking articles burns through a predetermined ratio of treated areas and untreated areas at any position along the length of the smoking article. In this manner, at least some portion of untreated area is burned along the entire smoking length of the smoking article so as to moderate any effect the treated areas may have on smoke delivery or taste. The ratio of treated to untreated areas may be relatively constant along the smoking length of the smoking article, or the ratio may vary along the smoking length.

In one particular embodiment of the patterned treated areas, zig-zagged bands are disposed around the smoking article. The bands are spaced apart from each other and aligned so that the circumferential burn line always encounters at least some portion of at least one of the zig-zagged bands in at least some portion of an untreated area. Alternatively, the treated areas may be defined as interlocking irregular shapes over at least a portion of the smoking length of the smoking article. Likewise, the treated areas may be defined as interlocking regular shapes, such as circles, squares, or other uniform repeating shapes. The treated areas may also be defined as non-interlocking irregular shapes over at least a portion of the smoking article. The irregular shapes are spaced between each other so that the circumferential burn line always encounters at least some portion of at least one of the irregular shaped treated areas and at least some portion of an untreated area.

In one preferred embodiment of the invention, the solvent soluble cellulosic polymer comprises ethyl cellulose in a concentration of around 15% to 35% by weight of solution. The non-aqueous solvent in this embodiment comprises a mixture of an alcohol and acetate, such as a 50/50 mixture of isopropyl alcohol and ethyl acetate. Other cellulosic polymers and solvents are contemplated and are within the scope and spirit of the invention.

The solution also includes a relatively fine particulate filler material suspended in solution. The filler material is an inorganic non-reactive material which, together with the cellulosic polymer, forms a film on the wrapper once the non-aqueous solvent is removed by a drying process. Applicants have found that suitable fillers include chalk, clay, and titanium oxide. Other suitable fillers may also exist.

A particularly desirable feature of the present invention is that the solution can be applied to the wrapper in relatively high speed commercial printing processes, such as gravure or flexography printing techniques. The solution can be applied to the wrapper paper in a single pass or multiple passes to achieve the desired reduction in permeability. The viscosity of the solution can be adjusted accordingly depending on the number of passes.

In further accordance with the objects of the invention, a smoking article wrapper is provided having improved ignition proclivity control characteristics. The wrapper comprises a paper web with discrete areas of an outer circumferential surface thereof treated with a non-aqueous solution of a solvent soluble film forming cellulosic material dissolved in a non-aqueous solvent. The solution also includes a particulate non-reactive filler material suspended in solution. The characteristics and embodiments of this wrapper include those discussed above in regards to the smoking article of the present invention.

The present invention also includes a method for producing a smoking article wrapper having improved ignition proclivity control characteristics. The method includes applying a non-aqueous solution of a film forming cellulosic polymer and non-aqueous solvent with an inorganic particulate filler material suspended in solution to a smoking article paper in discrete treated areas. The treated areas are dried, for example through applied heated air, so that essentially all of the non-aqueous solvent is removed leaving a film of the cellulosic material and filler material on the paper in the treated areas. The method includes applying the non-aqueous solution so that the dried treated areas have a permeability of less than 6 ml/min/cm$^2$, preferably within a range of 2 to 6 ml/min/cm$^2$. In this manner, oxygen to the smoking article is reduced as the smoking article burns into the treated areas if dropped or left unattended on a flammable substrate.

The method may further include applying the non-aqueous solution to the paper in discrete bands in a cross-direction on the paper, and spacing the bands apart from each other at a distance of between 5 to 10 mm. The bands preferably have a width of at least 4 mm.

The method further includes applying the non-aqueous solution to the paper in patterns which are designed to have a minimal affect on smoke delivery and taste of the smoking article. The patterns can have any manner of regular repeating shapes or irregular shapes and are designed so that a circumferential burn line advancing the length of the smoking article always burns at least some portion of untreated area and treated area.

The method preferably includes printing the treated areas in a commercial high-speed printing process, such as a flexographic or gravure printing process. The areas may be applied in these printing processes in a single pass or multiple passes.

The accompanying drawings, which are incorporated in and constitute a part of the specification, illustrate embodiments of the invention and, together with the description, serve to explain the principles of the invention.

BRIEF DESCRIPTION OF THE DRAWINGS

FIG. 3*a* is a perspective view of a smoking article according to the invention having a unique pattern of treated areas defined on the wrapper;

FIG. 3*b* is a flat view of the wrapper utilized in FIG. 3*a;*

FIG. 4*a* is an alternative partial perspective view of a smoking article according to the invention having a zigzagged pattern of treated areas defined on the wrapper;

FIG. 4*b* is a flat view of the wrapper utilized in FIG. 4*a*; and

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, not as a limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents.

For purposes of explanation of the invention, the embodiments and principles of the invention will be discussed in regards to a cigarette. However, this is for purposes of explanation of the invention only and is not meant to limit the invention only to cigarettes. Any manner of smoking article is within the scope and spirit of the invention.

The invention relates to a smoking article, and a wrapper for a smoking article, having improved ignition proclivity control characteristics. "Ignition proclivity" is a measure of the tendency of the smoking article or cigarette to ignite a flammable substrate if the burning cigarette is dropped or otherwise left on a flammable substrate. A test for ignition proclivity of a cigarette has been established by NIST (National Institute of Standards and Technology) and comprises placing a smoldering cigarette on a flammable test fabric and recording the tendency of the cigarette to either ignite the test fabric, burn the test fabric beyond a normal char line of the fabric, burn its entire length without igniting the fabric, or self-extinguish before igniting the test fabric or burning its entire length.

Figure 1:
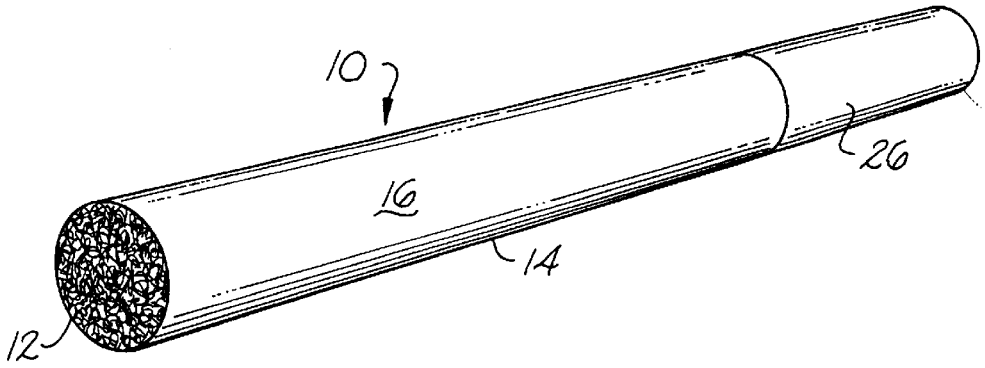
FIG. 1 is a perspective view of a smoking article according to the invention.
Figure 2:
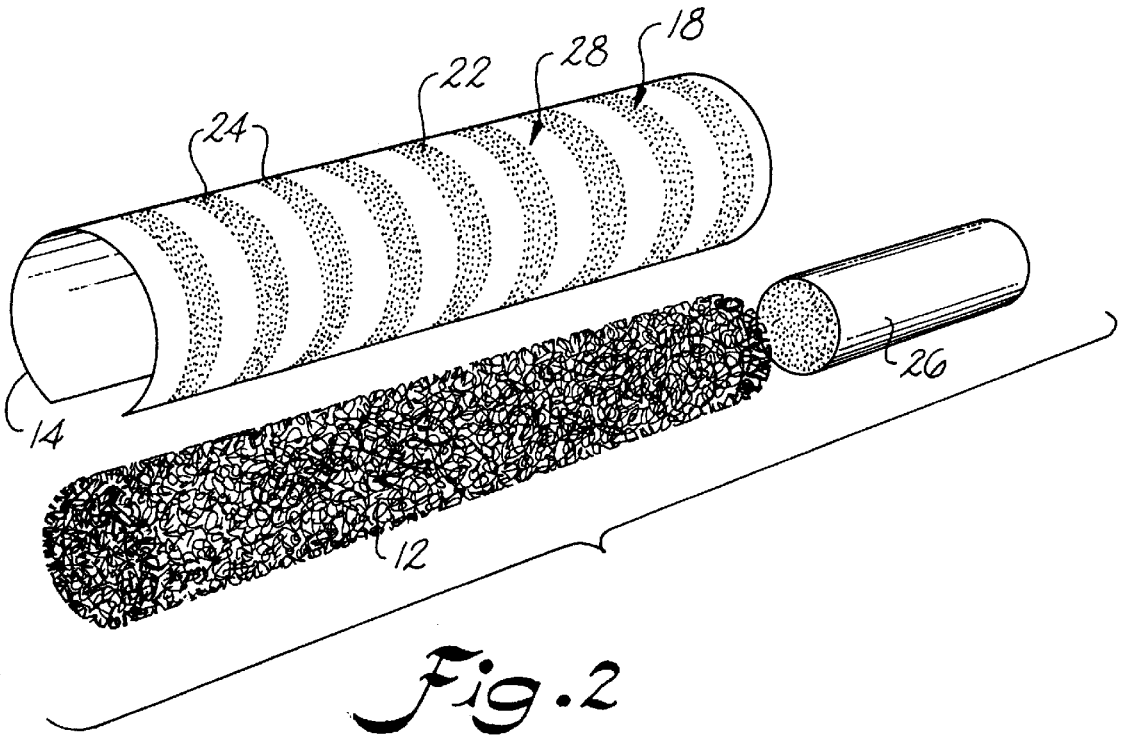
FIG. 2 is a component view of the smoking article of FIG. 1 particularly illustrating the treated areas of the smoking article wrapper.

A preferred embodiment of the invention is illustrated generally in FIGS. 1 and 2. A smoking article (cigarette), generally 10, having improved ignition proclivity characteristics includes a tobacco column 12 within a wrapper 14. Article 10 may include a filter 26. Wrapper 14 may include any manner of commercially available cigarette wrapper, such as KC grade 603 paper by Kimberly-Clark Corporation. It should be understood that any other manner of paper web may be used in this regard.

Paper web 14 defines an outer circumferential surface 16 when wrapped around tobacco column 12. Discrete areas 18 of outer circumferential surface 16 are treated with a non-aqueous solution. This solution includes a solvent soluble cellulosic polymer material dissolved in a non-aqueous solvent. The solution also includes a particulate inorganic non-reactive filler disbursed or suspended in the solution, as discussed more fully below. It should also be understood that treated areas 18 could also be disposed on the inner surface of wrapper 14. In other words, wrapper 14 could be rolled around tobacco column 12 so that treated areas 18 are adjacent the tobacco.

In the embodiment illustrated in FIGS. 1 and 2, treated areas 18 are defined as circumferential cross-directional bands 24. Bands 24 are spaced apart from each other longitudinally along the length of cigarette 10. The bands 24, and particularly the fine particulate filler 22 are indicated in phantom in FIG. 2. However, it should be understood that the treated areas are essentially invisible in the formed cigarette as shown in FIG. 1. In other words, a smoker cannot discern from any outward sign that the wrapper 14 has been treated in discrete areas 18. In this regard, treated areas 18 have a smooth and flat texture essentially the same as untreated areas 28.

The width and spacing of bands 24 are dependent on a number of variables, such as the initial permeability of wrapper 14, density of tobacco column 12, etc. The bands 24 preferably have a width so that oxygen is limited to the burning coal for a sufficient length or period of time to extinguish the coal. In other words, if band 24 were too narrow, the burning coal would burn through band 24 before self-extinguishing. Applicants have determined that, for the cigarettes tested, a minimum band width of 4 mm is desired.

The spacing between bands 24 is also a factor of a number of variables. The spacing should not be so great that the cigarette burns for a sufficient length or time to ignite a substrate before the coal ever burns into a treated area 18. The spacing between bands 24 also affects the thermal inertia of the burning coal, or the ability of the coal to burn through the treated bands 24 without self-extinguishing. In other words, the spacing between bands 24 should not be so great that the burning coal burns hot enough and fast enough to burn through one of the bands 24 when it comes into contact with the respective band. On the other hand, the spacing between bands 24 should not be so small that the cigarette tends to burn out or self-extinguish in a free burn state. In the cigarettes tested, applicants have found that a band spacing of between 5 and 10 mm is appropriate. However, it should be understood that the band spacing can be any suitable width as determined by any number of variables.

Although the cross-directional (CD) bands of permeability reducing areas have been shown to be particularly effective in reducing permeability and ignition propensity of cigarettes, it is possible that such bands may also have an undesirable discontinuous effect on the delivery of smoke and taste to the smoker. For example, if the change in permeability between the treated areas and untreated areas of the cigarette is relatively great, the smoker may discern a difference in taste and smoke delivery. Accordingly, the present invention also relates to unique designs or profiles of the treated areas to minimize the affect of the areas on smoke delivery and taste to the smoker. The present unique designs for the treated areas provide a more uniform smoke delivery over the entire length of the cigarette.

Examples of preferred designs for the treated areas are shown particularly in FIGS. 3 through 5. In all of the examples illustrated, treated areas 18 are defined in relation to untreated areas 28 so that a circumferential burn line 32 (as seen in FIGS. 3*b* and 4*b*) advancing in a burning direction of the smoking article, for example towards filter 26, burns through some ratio of treated areas 18 and untreated areas 28 at any position along the smoking length of article 10. For example, referring particularly to FIGS. 3*a* and 3*b*, treated areas 18 are defined as crossed bands 24 which form essentially a diamond pattern 48. Referring to burn lines 32, it can be seen that as the burn line advances along the length of the cigarette, it will always burn through a ratio of treated areas 18 versus untreated areas 28. In this manner, since at least some portion of untreated area is always being burned, the smoker is never puffing on an area comprising only treated areas. Thus, the change in taste or smoke delivery resulting from the differences in permeability will be less discernable to the smoker. The smoker will encounter a more uniform taste and smoke delivery over the entire length of the smoking article.

An alternative embodiment of a pattern for treated areas 18 is shown in FIGS. 4*a* and 4*b*. In this embodiment, treated areas 18 comprise bands 24 disposed in a zig-zagged pattern 34. The zig-zagged lines are spaced from one another and aligned so that burn line 32 always encounters at least some portion of a zig-zagged band 24 and at least some portion of an untreated area 28, as particularly seen in FIG. 4*b*.

The pattern for treated areas 18 can comprise any manner of design which allows for the burn line 32 to burn at least some ratio of treated area 28 versus non-treated area 18. The ratio between treated areas and untreated areas 28 may remain constant over the entire length of the cigarette, for example, as in the embodiment of FIG. 5*a*, or the ratio may vary along the length of the cigarette, as for example in the embodiments of FIGS. 5*b*, 5*c*, and 5*d*.

Figure 5A:
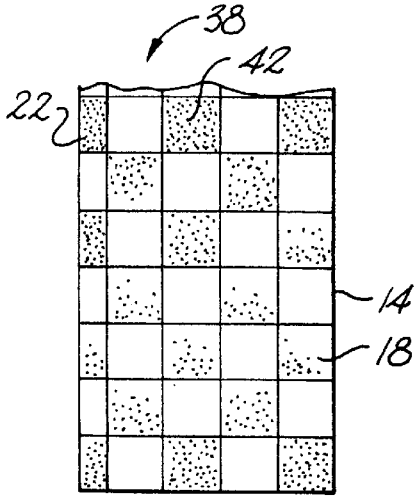
FIGS. 5*a* through 5*f* are alternative views of patterns of treated areas which may be defined on the smoking article wrapper for minimizing the effect of the porosity reducing solution on taste and smoke delivery.
Figure 5B:
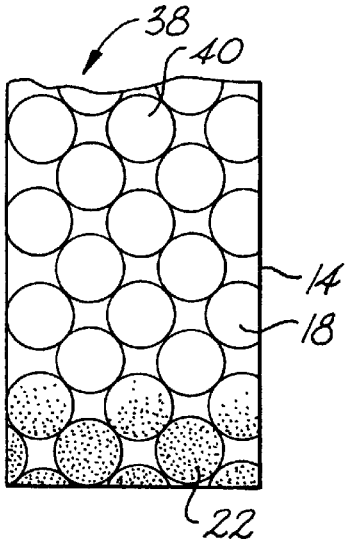
Figure 5C:
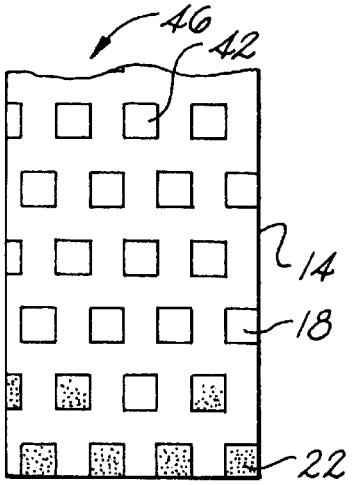
Figure 5D:
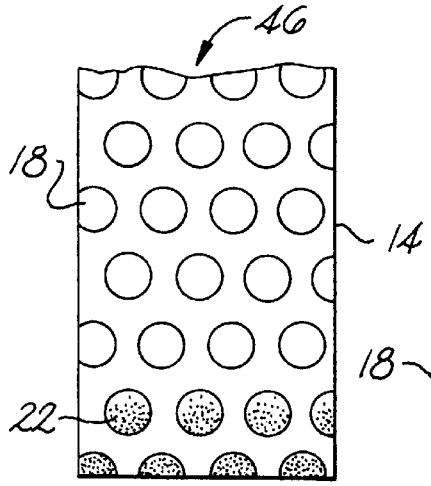
Figure 5E:
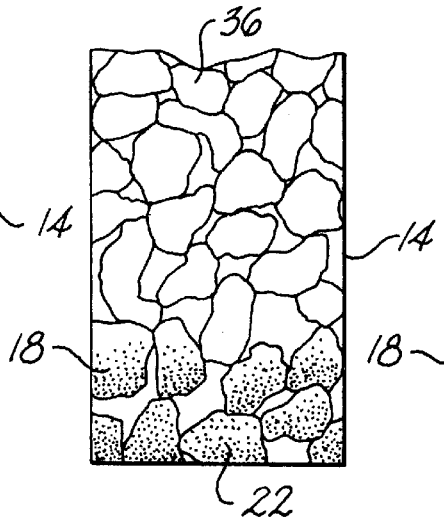
Figure 5F:
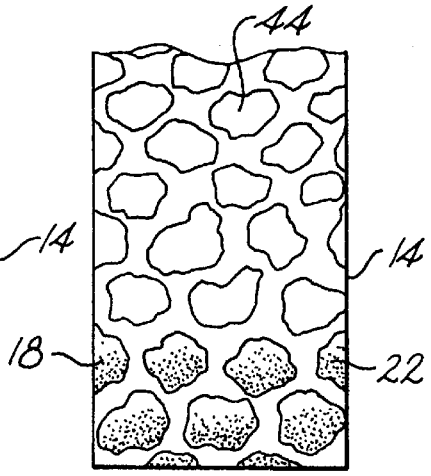

The unique patterns for treated areas 18 may comprise a pattern of interlocking regular shapes 38, such as squares 42 in FIG. 5*a* and circles 40 in FIG. 5*b*. The treated areas are interlocking in that they are connected or touching over the entire pattern. Alternatively, treated areas 18 may be defined in a pattern of interlocking irregular shapes 36, as illustrated in FIG. 5*e*. Alternatively, the treated areas may be defined as a pattern 46 of non-interlocking regular shapes, for example as shown in FIGS. 5*c* and 5*d*. And yet with another embodiment, treated areas 18 may be defined as a pattern 44 of non-interlocking irregular shapes, such as illustrated in FIGS. 5*f*. It should be understood that any manner of design or profile for treated areas is contemplated within the scope and spirit of the invention.

Treated areas 18 have a permeability within a range which is known to provide improved ignition proclivity characteristics for the make-up of cigarette 10. As the coal of cigarette 10 burns into treated areas 18, oxygen available to the burning coal is substantially reduced due to the decreased permeability of wrapper 14 in the treated areas. The reduction of oxygen preferably causes the cigarette to self-extinguish in the treated areas 18 when in contact with a substrate. Applicants have determined that a preferred permeability is less than 6 ml/min/cm$^2$ (CORTESA), and generally within a range of 2 to 6 ml/min/cm$^2$. Applicants have found that this range provides the desired self-extinguishing results as the cigarette coal burns into the treated areas.

The solution applied to wrapper 14 in treated areas 18 provides the reduced permeability in the treated areas. Applicants have found that a non-aqueous solution of a solvent soluble cellulosic polymer with a particulate inorganic non-reactive filler suspended in solution works particularly well. The non-aqueous solvent tends not to disrupt the inter-fiber bonding (e.g. hydrogen bonding) of the paper web and, thus, does not significantly decrease the strength of the paper web. Also, the non-aqueous solvent does not cause the paper web to crinkle or pucker when the solvent is dried. This allows for the wrapper 14 to have a smooth and aesthetically pleasing appearance.

Applicants have found that a particularly well suited non-aqueous solvent is a mixture of an alcohol and an acetate, for example a 50/50 mix of isopropyl alcohol and ethyl acetate. However, it should be understood, that this is but a preferred solvent, and any suitable non-aqueous solvent or solvent mixture may be utilized in this regard. For example a 60/40 mix of normal propyl acetate and normal propyl alcohol has also been shown to work particularly well. Applicants have also found that a well suited solvent soluble cellulosic polymer is ethyl cellulose. The ethyl cellulose is generally in concentration of about 15% to 35% by weight of solution, and preferably about 25% by weight of solution. However, any cellulosic based polymer can be used in this regard, including hydroxy propyl cellulose.

A non-reactive inorganic particulate filler 22 is added to the solution. Applicants have found that filler 22 significantly improves the ability of the treated areas 18 to self-extinguish the burning coal. The solution with filler is more effective in reducing permeability of the paper web in treated areas 18. Applicants believe that the inorganic filler 22 forms a layer on the surface of wrapper 14 with the ethyl cellulose acting as a binder or "glue" for the filler particles. Applicants believe that the filler particles tend not to strike into the pores of wrapper 16 and form a relatively smooth surface coating. The filler and cellulosic polymer form a coherent and smooth surface coating which significantly reduces paper permeability in the treated areas. It is also believed that the solution containing the inorganic filler particles is less affected by the heat of the burning cigarette, thus ensuring that the coating remains intact so as to be effective in restricting oxygen to the burning coal.

Any number of inorganic fillers may be suitable in the present invention. Any filler material which can be homogeneously disbursed in the non-aqueous solution to form a surface film with the cellulosic polymer without affecting the texture or appearance of the wrapper may be used. Applicants have found that particularly well-suited fillers are chalk, clay, and titanium oxide.

The present invention also pertains to a smoking article wrapper for use with smoking articles, as essentially described above, as well as a method for making the smoking article wrapper. The inventive method for producing the smoking article wrapper having improved ignition proclivity control characteristics includes applying a non-aqueous solution of a film forming cellulosic polymer and non-aqueous solvent with an inorganic particulate filler material suspended in the solution to a smoking article paper in discrete treated areas 18, such as bands 24 as described above. The treated areas are then dried so that essentially all of the non-aqueous solvent is removed leaving a film of the cellulosic material and filler material on the paper in treated areas 18. The method includes applying the non-aqueous solution so that dried treated areas 18 have a permeability within a range known to cause self-extinguishing of the cigarettes, for example, within a range of 2 to 6 ml/min/cm$^2$.

The method also includes printing the solution onto the paper web in the discrete areas by means of conventional high speed printing operations. Applicants have found that suitable printing techniques include gravure and flexographic printing. The treated areas can be applied in the printing operations in either a single pass or multiple passes. The viscosity of the solution is controlled accordingly to be suitable with the high speed printing techniques. Applicants have also found that the desired target permeability ranges are readily achieved by applying the solution to the treated areas in multiple passes with the conventional printing machines. However, it is also possible to achieve the desired permeability range by applying the solution in a single pass and controlling the viscosity and amount of solution applied.

The following examples relate to cigarettes produced according to the invention and are provided to more fully explain the invention. In each of the examples, the coatings were applied in a three pass process without intermediate drying. The base paper was Kimberly-Clark grade 603 paper with an average untreated permeability of 32.6 ml/min/cm$^2$. The measured viscosity for the solution was 45 seconds using a Zahn #2 Cup Viscometer.

EXAMPLE 1

In a first series, ALPHATEX clay (Anhydrous China clay) by Anglo-American Clay Corporation was added to a base solution of ethyl cellulose (approximately 25% by weight of solution) dissolved in a 60/40 mixture of normal propyl acetate and normal propyl alcohol. A 10 mm band of solution was printed in a 3-pass process on a base Kimberly-Clark KC Grade 603 paper with an initial average porosity of 32.6 ml/min/cm$^2$. The clay was added at 3% weight of solution with a coat weight of the treated areas of 3.0 g/m$^2$. Average permeability of this set of cigarettes was 3.1 ml/min/cm$^2$. 3 of 3 cigarettes tested self-extinguished at or near the coated area.

EXAMPLE 2

In a second series, ALPHATEX clay (Anhydrous China clay) by Anglo-American Clay Corporation was added to a base solution of ethyl cellulose (approximately 25% by weight of solution) dissolved in a 60/40 mixture of normal propyl acetate and normal propyl alcohol. A 10 mm band of solution was printed in a 3-pass process on a base Kimberly-Clark KC Grade 603 paper with an initial average porosity of 32.6 ml/min/cm$^2$. The clay was added at 6% weight of solution. Average permeability of this set was 1.6 ml/min/cm$^2$. 4 of 4 cigarettes tested self-extinguished at or near the coated area.

EXAMPLE 3

In a third series, $TiO_2$ was added to a base solution of ethyl cellulose (approximately 25% by weight of solution) dissolved in a 60/40 mixture of normal propyl acetate and normal propyl alcohol. The $TiO_2$ was added in the form of a white ink. The ink was approximately 10% $TiO_2$ with a nitrocellulose binder. A 10 mm band of solution was printed in a 3-pass process on a base Kimberly-Clark KC Grade 603 paper with an initial average porosity of 32.6 ml/min/cm$^2$. The $TiO_2$ was added at 0.5% by weight of solution with a coat weight of the treated areas being 3.4 g/m$^2$. Average permeability of this set was 3.2 ml/min/cm$^2$. 4 of 4 cigarettes tested self-extinguished at or near the coated area.

EXAMPLE 4

In a fourth series, $TiO_2$ was added to a base solution of ethyl cellulose (approximately 25% by weight of solution) dissolved in a 60/40 mixture of normal propyl acetate and normal propyl alcohol. The $TiO_2$ was added in the form of a white ink. The ink was approximately 10% $TiO_2$ with a nitrocellulose binder. A 10 mm band of solution was printed in a 3-pass process on a base Kimberly-Clark KC Grade 603 paper with an initial average porosity of 32.6 ml/min/cm$^2$. The $TiO_2$ was added at 1.0% by weight of solution with a coat weight of the treated areas being 4.2 g/m$^2$. Average permeability of this set was 1.8 ml/min/cm$^2$. 4 of 4 cigarettes tested self-extinguished at or near the coated area.

EXAMPLE 5

In a fifth series, $TiO_2$ was added to a base solution of ethyl cellulose (approximately 25% by weight of solution) dissolved in a 60/40 mixture of normal propyl acetate and normal propyl alcohol. The $TiO_2$ was added in the form of a white ink. The ink was approximately 10% $TiO_2$ with a nitrocellulose binder. A 10 mm band of solution was printed in a 3-pass process on a base Kimberly-Clark KC Grade 603 paper with an initial average porosity of 32.6 ml/min/cm$^2$. The $TiO_2$ was added at 1.2% by weight of solution with a coat weight of the treated areas being 4.7 g/m$^2$. Average permeability of this set was 0.91 ml/min/cm$^2$. 4 of 4 cigarettes tested self-extinguished at or near the coated area.

EXAMPLE 6

In a sixth series, $TiO_2$ was added to a base solution of ethyl cellulose (approximately 25% by weight of solution) dissolved in a 60/40 mixture of normal propyl acetate and normal propyl alcohol. The $TiO_2$ was added in the form of a white ink. The ink was approximately 10% $TiO_2$ with a nitrocellulose binder. A 10 mm band of solution was printed in a 3-pass process on a base Kimberly-Clark KC Grade 603 paper with an initial average porosity of 32.6 ml/min/cm$^2$. The $TiO_2$ was added at 2.5% by weight of solution with a coat weight of the treated areas being 4.9 g/m$^2$. Average permeability of this set was 0.74 ml/min/cm$^2$. Since the permeability of this set was less than the 0.91 of Example 5, it was not necessary to test for ignition proclivity. It was fully expected any cigarettes treated with the composition would self-extinguish.

EXAMPLE 7

In a seventh series, $TiO_2$ was added to a base solution of ethyl cellulose (approximately 25% by weight of solution) dissolved in a 60/40 mixture of normal propyl acetate and normal propyl alcohol. The $TiO_2$ was added in the form of a white ink. The ink was approximately 10% $TiO_2$ with a nitrocellulose binder. A 10 mm band of solution was printed in a 3-pass process on a base Kimberly-Clark KC Grade 603 paper with an initial average porosity of 32.6 ml/min/cm$^2$. The $TiO_2$ was added at 5.0% by weight of solution with a coat weight of the treated areas being 9.7 g/m$^2$. Average permeability of this set was 0.29 ml/min/cm$^2$. Since the permeability of this set was less than the 0.91 of Example 5, it was not necessary to test for ignition proclivity. It was fully expected that any cigarettes treated with the composition would self-extinguish.

EXAMPLE 8

In another series, MULTIFLEX chalk (precipitated calcium carbonate) from Specialty Minerals, Inc. was added to a base solution of ethyl cellulose (approximately 25% by weight of solution) in a 50/50 solvent of normal propyl acetate and normal propyl alcohol. The chalk was added at 9% weight of solution. 5 mm cross direction bands were printed on a base Kimberly-Clark KC Grade 603 paper with an initial average porosity of 32.6 ml/min/cm$^2$ in a 3-pass gravure printing operation. Average permeability for the treated areas was less than 2 ml/min/cm$^2$. In ignition proclivity tests conducted on a #4 cotton duck material with a film underneath, 3 of 5 cigarettes self-extinguished and 1 cigarette burned its entire length without igniting the substrate. In tests conducted on a #6 cotton duck material without film, 1 of 6 cigarettes self-extinguished. In this test, it appeared that the 5 mm band width was not enough to extinguish the cigarette and the 10 mm band spacing was too great to prevent an ignition.

EXAMPLE 9

In this series, a square cross-hatch or diamond pattern was printed on Kimberly-Clark Grade 603 paper. The pattern consisted of 2 mm wide bands spaced 4 mm apart and disposed at a 45 degree angle. The pattern was printed on a commercial gravure press in a 3 pass process. The solution used was ethyl cellulose (approximately 25% by weight of solution) in a 50/50 solvent of normal-propyl acetate and normal-propyl alcohol with Multiflex chalk added at 9% weight of solution. With the Multiflex chalk filler, viscosity of the solution was 39 cup seconds. In ignition proclivity tests conducted on a #4 cotton duck material with a film underneath, 5 of 6 cigarettes self-extinguished. In tests conducted on a #6 cotton duck material without film, 4 of 6 cigarettes self-extinguished.

It will be apparent to those skilled in the art that various modifications and variations can be made in the present invention without departing from the scope or spirit of the invention. For example, features illustrated or described as part of one embodiment can be combined in another embodiment to yield a still further embodiment. Thus, it is intended that the present invention cover the modifications and variations of this invention provided they come within the scope of the appended claims and their equivalents.

What is claimed is:

1. A smoking article having improved ignition proclivity characteristics, said article comprising a tobacco column within a wrapper, said wrapper comprising a paper web with untreated areas and discrete areas thereof treated with a non-aqueous solution of a solvent soluble cellulosic polymer dissolved in a non-aqueous solvent and a particulate inorganic non-reactive filler suspended in said solution to form a film on said wrapper in said treated discrete areas, said treated discrete areas having a relatively smooth and flat texture and comprising a permeability within a predetermined range sufficient to reduce ignition proclivity, said treated areas reducing ignition proclivity by reducing oxygen to a smoldering coal of the cigarette as the coal burns and advances into said treated areas.

2. The article as in claim 1, wherein said treated areas comprise a permeability of less than 6 ml/min/cm$^2$.

3. The article as in claim 1, wherein said treated areas comprise a plurality of discrete circumferential bands disposed longitudinally along said smoking article.

4. The article as in claim 3, wherein said bands have a width of greater than 4 mm.

5. The article as in claim 3, wherein said bands are spaced from each other at a distance essentially between 5 and 10 mm.

6. The article as in claim 1, wherein said solvent soluble cellulosic polymer comprises ethyl cellulose.

7. The article as in claim 1, wherein said non-aqueous solvent comprises a mixture of an alcohol and an acetate.

8. The article as in claim 1, wherein said filler comprises any combination of chalk, clay, or titanium oxide.

9. The article as in claim 1, wherein said solvent soluble cellulosic polymer comprises ethyl cellulose and said non-aqueous solvent comprises a mixture of isopropyl alcohol and ethyl acetate, and said filler comprises one of chalk, clay, or titanium oxide.

10. The article as in claim 1, wherein said solvent soluble cellulosic polymer comprises hydroxy propyl cellulose.

11. The article as in claim 1, wherein said treated areas are applied to said paper web in a direct pass printing technique.

12. The article as in claim 11, wherein said treated areas are applied to said paper web by way of one of flexography, direct gravure, or offset gravure printing techniques.

13. The article as in claim 1, wherein said treated areas are defined on said wrapper in a pattern such that a predetermined ratio exists between said treated areas and untreated areas at any longitudinal position along a smoking length of said smoking article, wherein at least some portion of said untreated areas is present along the entire smoking length of said smoking article.

14. The article as in claim 13, wherein said ratio of treated to untreated areas is relatively constant along said smoking length of said smoking article.

15. The article as in claim 13, wherein said ratio of treated to untreated areas varies along said smoking length of said smoking article.

16. The article as in claim 13, wherein said treated areas are defined as interlocking irregular shapes over at least a portion of said smoking length of said smoking article.

17. The article as in claim 13, wherein said treated areas are defined as interlocking regular shapes over at least a portion of said smoking length of said smoking article.

18. The article as in claim 17, wherein said regular shapes are one of circles, squares, or other uniform repeating shape.

19. The smoking article as in claim 13, wherein said treated areas are defined as non-interlocking irregular shapes over at least a portion of said smoking article, said irregular shapes spaced between each other so that at least some portion of at least one said irregular shaped treated area and at least some portion of said untreated areas are present at each longitudinal position along the entire smoking length of said smoking article.

20. The smoking article as in claim 13, wherein said treated areas are defined as criss-crossed bands disposed along said smoking article.

21. A smoking article wrapper having improved ignition proclivity control characteristics, said wrapper comprising a paper web with untreated areas and discrete areas thereof treated with a non-aqueous solution of a solvent soluble film forming cellulosic material dissolved in a non-aqueous solvent with a particulate non-reactive filler material suspended in solution, said treated discrete areas having a relatively smooth and flat texture and comprising a permeability of less than 6 ml/min/cm$^2$.

22. The wrapper as in claim 21, wherein said treated areas comprise a plurality of discrete bands disposed in a criss-crossed direction on said wrapper.

23. The wrapper as in claim 22, wherein said bands have a width greater than 4 mm.

24. The wrapper as in claim 22, wherein said bands are spaced from each other at a distance within a range of essentially 5–10 mm.

25. The wrapper as in claim 21, wherein said film forming cellulosic material comprises ethyl cellulose.

26. The wrapper as in claim 21, wherein said non-aqueous solvent comprises a mixture of an alcohol and an acetate.

27. The wrapper as in claim 21, wherein said filler material comprises one of chalk, clay, or titanium oxide.

28. The wrapper as in claim 21, wherein said film forming cellulosic material comprises hydroxy propyl cellulose.

29. The wrapper as in claim 21, wherein said treated areas are defined on said wrapper in a pattern such that a predetermined ratio exists between said treated areas and untreated areas at any longitudinal position along a smoking length of said smoking article, wherein at least some portion of said untreated areas is present along the entire smoking length of said smoking article.

30. The wrapper as in claim 29, wherein said ratio of treated to untreated areas is relatively constant along said smoking length of said smoking article.

31. The wrapper as in claim 29, wherein said ratio of treated to untreated areas varies along said smoking length of said smoking article.

32. The wrapper as in claim 29, wherein said treated areas are defined as interlocking irregular shapes over at least a portion of said smoking length of said smoking article.

33. The wrapper as in claim 29, wherein said treated areas are defined as interlocking regular shapes over at least a portion of said smoking length of said smoking article.

34. The wrapper as in claim 29, wherein said treated areas are defined as non-interlocking irregular shapes over at least a portion of said smoking article, said irregular shapes spaced between each other so that at least some portion of at least one said irregular shaped treated area and at least some portion of said untreated areas are present at each longitudinal position along the entire smoking length of said smoking article.

* * * * *